US011473276B2

(12) United States Patent
Ismert

(10) Patent No.: US 11,473,276 B2
(45) Date of Patent: Oct. 18, 2022

(54) PLUMBING SERVICE BOX INSTALLATION

(71) Applicant: Sioux Chief Mfg. Co., Inc., Kansas City, MO (US)

(72) Inventor: Brian E. Ismert, Lone Jack, MO (US)

(73) Assignee: Sioux Chief Mfg. Co., Inc., Kansas City, MO (US)

( * ) Notice: Subject to any disclaimer, the term of this patent is extended or adjusted under 35 U.S.C. 154(b) by 460 days.

(21) Appl. No.: 16/586,486

(22) Filed: Sep. 27, 2019

(65) Prior Publication Data

US 2020/0102723 A1 Apr. 2, 2020

Related U.S. Application Data

(60) Provisional application No. 62/737,499, filed on Sep. 27, 2018.

(51) Int. Cl.

| | |
|---|---|
| ***F16L 5/00*** | (2006.01) |
| ***E03C 1/02*** | (2006.01) |
| ***E03C 1/06*** | (2006.01) |
| ***E03C 1/01*** | (2006.01) |

(52) U.S. Cl.

CPC ..... *E03C 1/021* (2013.01); *E03C 1/01* (2013.01); *E03C 1/06* (2013.01); *E03C 2201/80* (2013.01)

(58) Field of Classification Search

CPC ..... E03C 1/021; E03C 1/023; E03C 1/06; H02G 3/0691; H02G 3/086; Y10T 137/698; Y10T 137/7062; E03B 7/095

See application file for complete search history.

(56) References Cited

U.S. PATENT DOCUMENTS

| | | | | | |
|---|---|---|---|---|---|
| 674,582 | A | | 5/1901 | Lewy | |
| 812,021 | A | | 2/1906 | Dahl | |
| 887,826 | A | | 5/1908 | Maniex | |
| 1,483,453 | A | * | 2/1924 | Knoderer | H02G 3/086 220/3.94 |
| 1,857,787 | A | * | 5/1932 | Meeks | H02G 3/086 220/3.94 |
| 2,028,509 | A | * | 1/1936 | Knell | H02G 3/086 220/3.94 |
| 2,717,715 | A | * | 9/1955 | Whelan | H02G 3/086 D13/152 |
| 3,156,256 | A | | 11/1964 | Weaver | |
| 4,167,196 | A | | 9/1979 | Morris | |

(Continued)

*Primary Examiner* — Reinaldo Sanchez-Medina

(74) *Attorney, Agent, or Firm* — Avek IP, LLC; Kent R. Erickson

(57) ABSTRACT

A plumbing service box assembly is described. The assembly includes a box with a positioning-debris cover configured to be received through an open face of the box and that includes a receiver that engages the plumbing fitting. Engagement with the receiver retains the plumbing fitting orientation and position during installation in a structure. The positioning-debris cover may be retained for aesthetic appearance and/or to resist actuation of the fitting. A trim-piece provides a finished appearance to the installation and retains the positioning-debris cover in position. Top and bottom walls of the box include interchangeable adaptor plates that adapt to various plumbing conduit sizes as well as drain outlets or couplings. A secondary debris cover that encloses the positioning-debris cover within the box and further protects against entry of debris is also provided.

23 Claims, 10 Drawing Sheets

(56) References Cited

U.S. PATENT DOCUMENTS

| | | | | |
|---|---|---|---|---|
| 4,716,925 | A | 1/1988 | Prather | |
| 5,027,626 | A * | 7/1991 | Appelbaum | E05B 13/001 70/164 |
| 5,497,584 | A * | 3/1996 | Bergmann | E03C 1/042 285/193 |
| 5,806,555 | A | 9/1998 | Magno, Jr. | |
| 5,964,246 | A | 10/1999 | Meeker | |
| 6,085,780 | A | 6/2000 | Morris | |
| 6,435,206 | B1 | 8/2002 | Minnick | |
| 6,718,804 | B1 * | 4/2004 | Graves | F16K 27/12 137/553 |
| 7,178,546 | B2 | 2/2007 | Gremillion, III | |
| 7,360,553 | B1 * | 4/2008 | Ismert | F16L 5/10 137/360 |
| 7,735,511 | B1 | 6/2010 | Ismert | |
| 8,020,581 | B1 | 9/2011 | Julian et al. | |
| 9,133,606 | B2 | 9/2015 | Ericksen et al. | |
| 9,435,273 | B2 | 9/2016 | Sarder et al. | |
| 9,534,703 | B2 * | 1/2017 | Holmes | F16K 35/14 |
| 2005/0251908 | A1 * | 11/2005 | Doverspike | E03C 1/021 4/695 |
| 2010/0107640 | A1 * | 5/2010 | Smith | F16K 49/005 60/734 |
| 2011/0100486 | A1 * | 5/2011 | Brewton, III | F16K 27/12 137/382 |
| 2011/0180159 | A1 * | 7/2011 | Ericksen | E03B 7/095 137/364 |
| 2016/0029577 | A1 | 2/2016 | Brashear | |
| 2017/0074419 | A1 | 3/2017 | Tamarkin | |
| 2019/0003617 | A1 * | 1/2019 | Ismert | F16L 3/237 |

* cited by examiner

PLUMBING SERVICE BOX INSTALLATION

CROSS-REFERENCE TO RELATED APPLICATIONS

This application claims the benefit of U.S. Provisional Patent Application No. 62/737,499 filed Sep. 27, 2018, the disclosure of which is hereby incorporated herein in its entirety by reference.

BACKGROUND

It is common practice to install valves on plumbing lines to control the flow of fluid from a water supply. In residential construction a pressure control valve and a master supply valve are often installed on the incoming water supply line to a structure. In many instances it is beneficial to install these valves within a wall of the structure in a protected and aesthetically pleasing manner. The valves are typically installed in plastic mounting boxes that are secured to and/or within the wall structure.

The mounting boxes are typically specifically configured to a given application, supply line size, valve type, or the like. Installers thus must be prepared with a variety of different mounting boxes for a given installation in order to accommodate the various valves, outlets, or the like included in the installation. Such can require a large amount of space for transporting and storing an adequate collection of boxes for completion of the installation as well as a great deal of preplanning for the needs of a particular job.

Properly mounting and/or positioning the respective valve or fitting within the mounting box can also be somewhat difficult, especially when an installer is working independently. It can be difficult to maintain precise positioning and orientation of the valve within the box while making connections between the plumbing system and the valve. Oftentimes at the completion of an installation, the valve will not be centered within the box and/or may be rotated within the box making for a less than ideal aesthetic appearance and potentially hindering the operability of the valve.

Following completion of a plumbing installation, construction of the remainder of the structure continues. Dust and debris for this construction often collects in the mounting boxes which are open to the interior of the structure. As such, the boxes must be cleaned out when construction is complete. The valves mounted within the boxes are also open to inadvertent contact by the construction crews which can result in unwanted operation/opening of the valves and/or damage to the valves.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes a plumbing valve installation that maintains a proper position and alignment of a valve within a mounting box during installation, protects the valve from inadvertent operation or damage, and substantially prevents collection of construction debris in the mounting box.

The plumbing valve installation includes a mounting box configured for installation within a wall of a structure. Opposing ends of the mounting box include interchangeable plates that can be selectively installed to accommodate a variety of supply/outlet/drain line configurations. A positioning-debris cover is provided that is slideably received in an open front face of the mounting box.

The positioning-debris cover includes a planar body with a perimeter wall extending about the perimeter of the planar body and generally perpendicularly thereto. The body and the perimeter wall are dimensioned to fit within interior dimensions of the open front face of the mounting box but in close proximity to interior surfaces of the mounting box. An aperture is provided in the planar body and is sized and configured to receive at least a portion of a valve and/or a valve handle therein. When disposed in the mounting box, the positioning-debris cover engages at least a portion of a valve installed therein to properly position the valve and to maintain said position of the valve within the mounting box. The positioning-debris cover may also prevent actuation of the valve and entrance of debris into the mounting box. In one embodiment, a secondary debris cover may be provided that is configured substantially similarly to the positioning-debris cover and is disposable into the open face of the mounting box to enclose both the valve and the positioning-debris cover therein. Following completion of construction activities, the positioning-debris cover and/or the secondary debris cover may be removed or may remain in position to aid prevention of valve actuation. In some embodiments, the positioning-debris cover may be repositioned to act as an aesthetic cover while also enabling valve actuation.

DESCRIPTION OF THE DRAWINGS

Illustrative embodiments are described in detail below with reference to the attached drawing figures, and wherein.

DETAILED DESCRIPTION

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" or "substantially" as used herein denote deviations from the exact value by +/−10%, preferably by +/−5% and/or deviations in the form of changes that are insignificant to the function.

Figure 12:
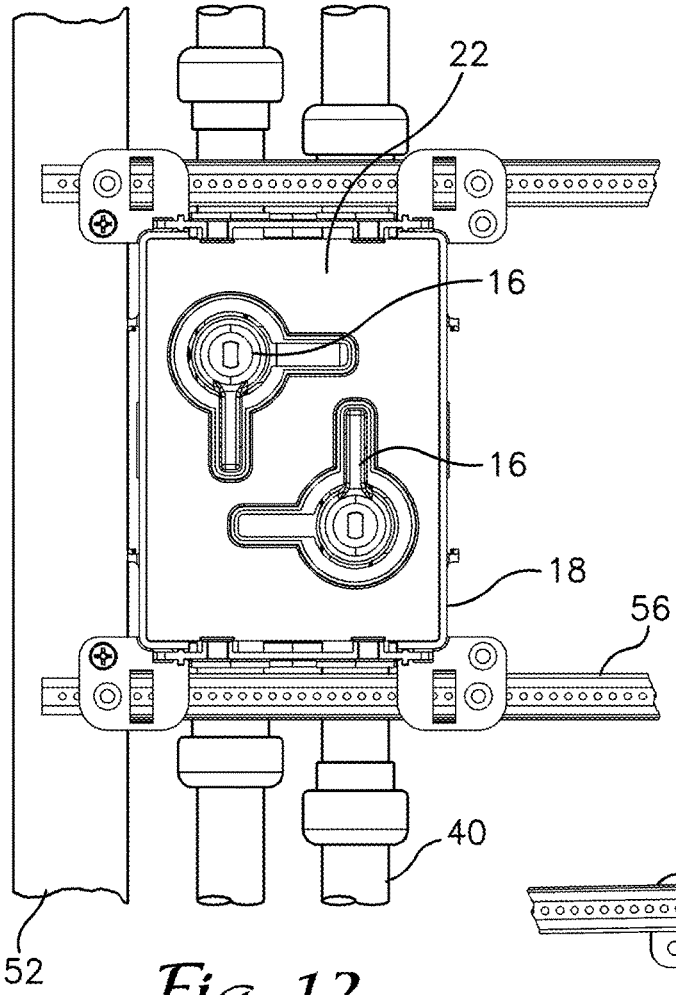
FIG. 12 is a front elevational view of a two-valve service box installation with a positioning-debris cover installed thereon depicted in accordance with an exemplary embodiment.
Figure 13:
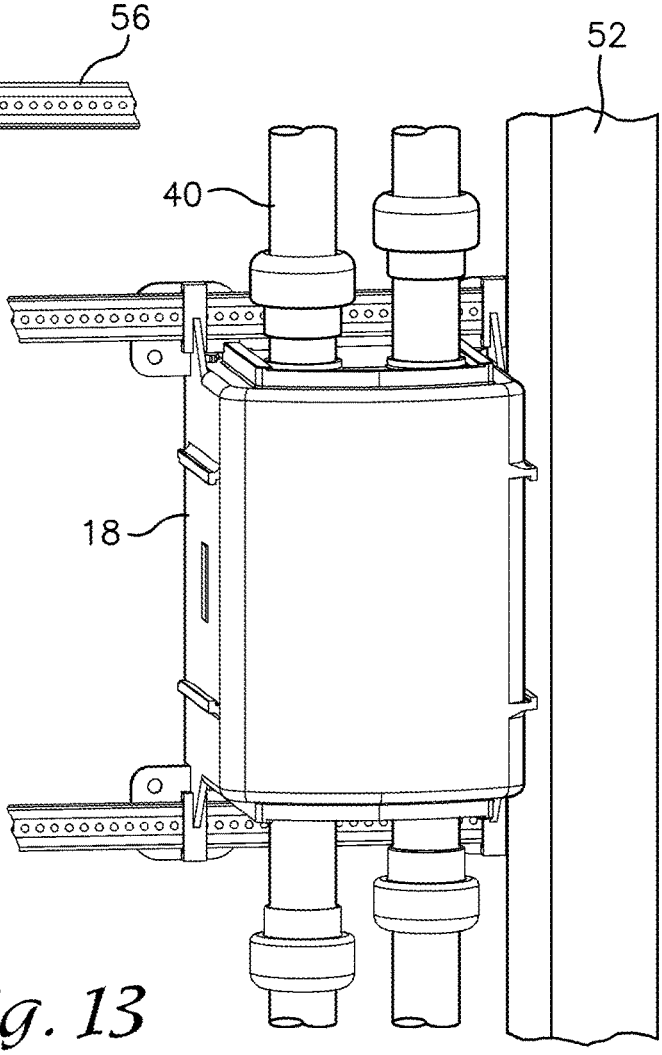
FIG. 13 is a back-side perspective view of the installation of FIG. 12.

With reference now to FIGS. 1-3 and 5, a plumbing service box assembly 10 is described in accordance with an exemplary embodiment. The plumbing service box assembly 10 is described herein with respect to installations involving a main service valve 14 (FIG. 1) and a pressure relief valve 12 (FIG. 2) such as those commonly installed in residential applications. However, embodiments may be configured for use with any of a variety of valves or other fitting-types, arrangements, or configurations without departing from the scope of embodiments described herein. For example, the plumbing service box assembly 10 may be adapted for installation of a pair of quarter-turn valves 16, such as for hot- and cold-water supplies, as depicted in FIGS. 12 and 13, among other configurations.

Figure 5:
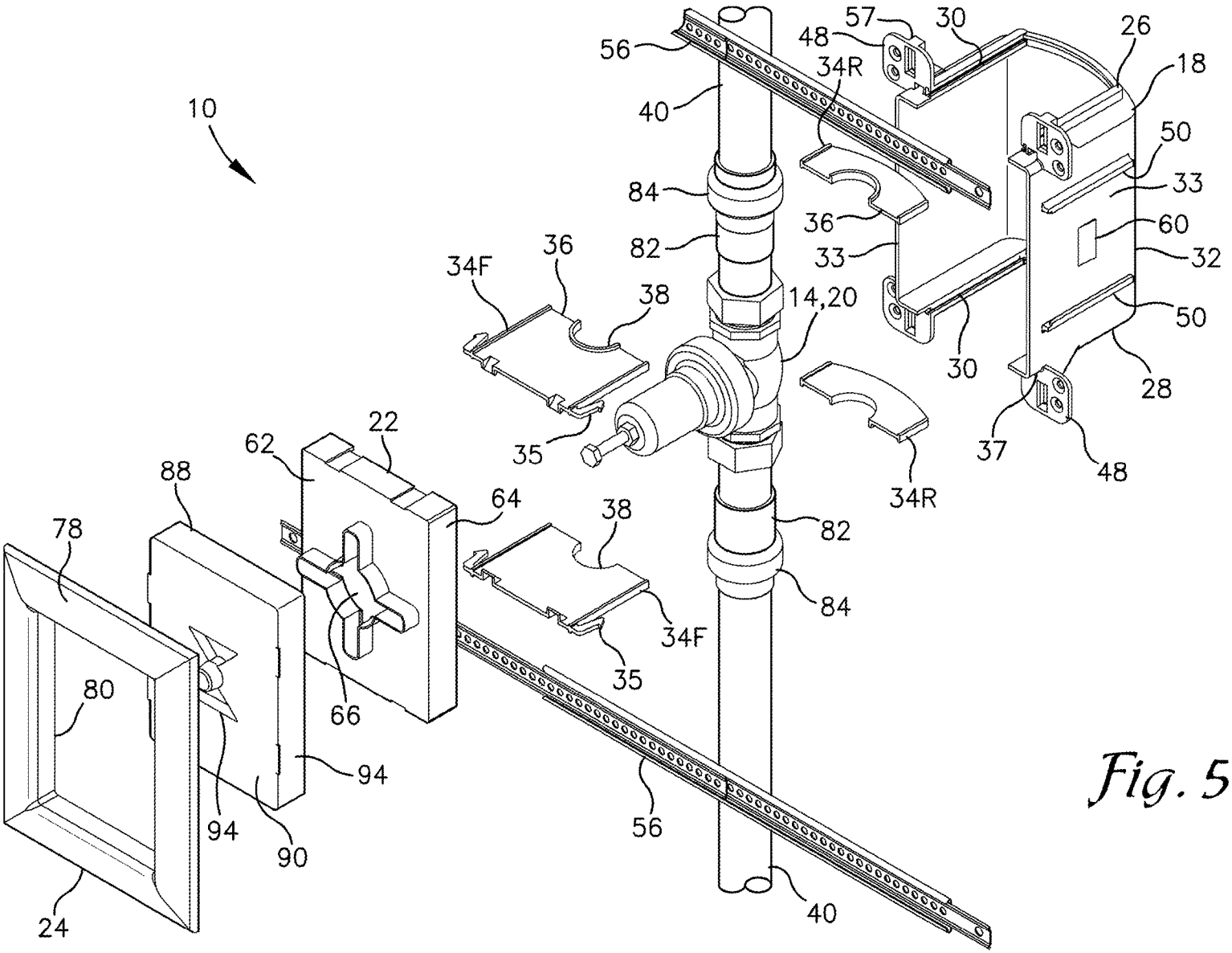
FIG. 5 is an exploded perspective view of a plumbing service box installation for a pressure-relief valve depicted in accordance with an exemplary embodiment.

The plumbing service box assembly 10 includes a service box 18, a plumbing fitting 20, such as the service valve 12, pressure-relief valve 14, or quarter-turn valve 16, a positioning-debris cover 22, and a finish trim-piece 24. As best depicted in FIG. 5, the service box 18 includes a generally hollow, cuboidal form having an open front face. Although described as cuboidal herein, the service box 18 need not include six planar sides or faces of equal dimensions that are arranged in parallel, spaced apart pairs to form a cube. Rather, the term cuboidal is intended to include configurations in which the service box 18 may be elongate in one or more dimensions. Further, the service box 18 may include one or more arcuate, rounded, or angled sides or faces without departing from the scope of embodiments described herein. For example, side faces and a rear face of the service box 18 may comprise a single continuous, arcuate surface. All such configurations are referred to generally herein as cuboidal.

Top and bottom walls 26, 28 of the valve-box 18 include cutouts that are open to the open front face of the service box 18 and include an inwardly facing slot 30 formed around the perimeter of the respective cutout. The slot 30 may extend around the complete perimeter of the cutout or may only extend along portions of opposing side edges thereof between the open front face of the service box 18 and near a rear wall 32 of the service box 18. In some embodiments, similar cutouts and slots 30 may be provided in one or both side walls 33 of the service box 18.

The slots 30 along each opposing edge the cutout are aligned in a single plane and configured to receive a pair of adaptor plates 34 therebetween. The adaptor plates 34 are sized and configured to be slideably disposed into the slots 30 and to enclose the respective top or bottom wall 26, 28 of the service box 18. In one embodiment, the slots 30 may be formed along a portion of a perimeter of the adaptor plates 34 instead of or in addition to being formed along the perimeter of the cutouts.

Mating, adjacent, or abutting edges 36 of the adaptor plates 34 form one or more apertures 38 when brought together in abutting relationship. The apertures 38 are sized and configured to receive plumbing conduits 40, e.g. pipe, tube, hose, or the like, therein and the pairs of adaptor plates 34 are selectable and interchangeable to enable an installer to select an appropriate pair of adaptor plates 34 for a particular plumbing conduit size to be employed.

Figure 14:
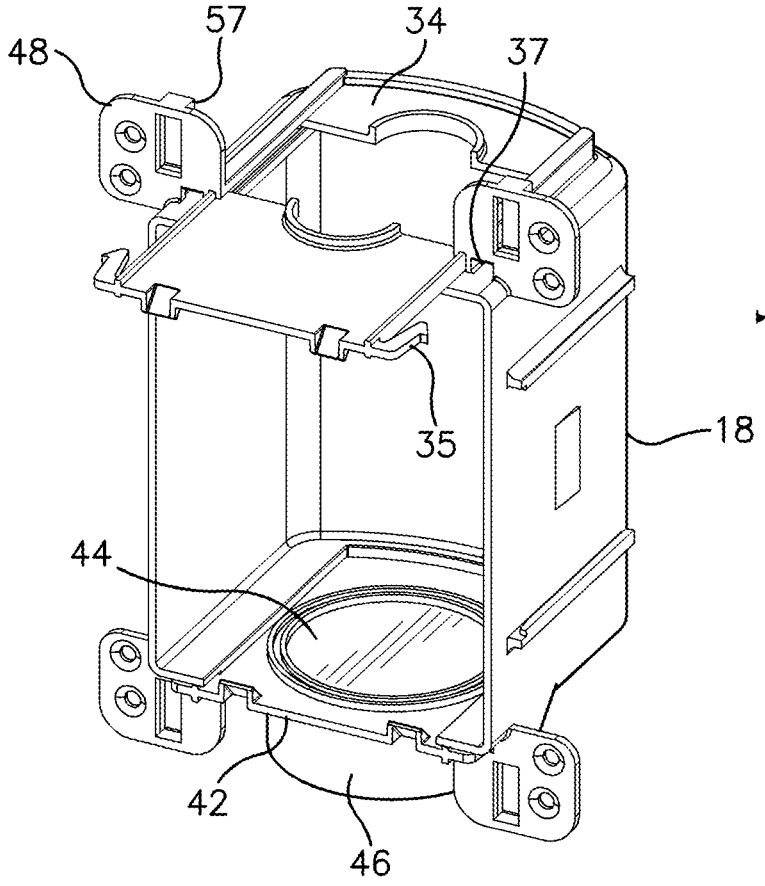
FIGS. 14 and 15 are front-side perspective views of plumbing service boxes having bottom walls thereof adapted for use with drain lines depicted in accordance with exemplary embodiments.
Figure 15:
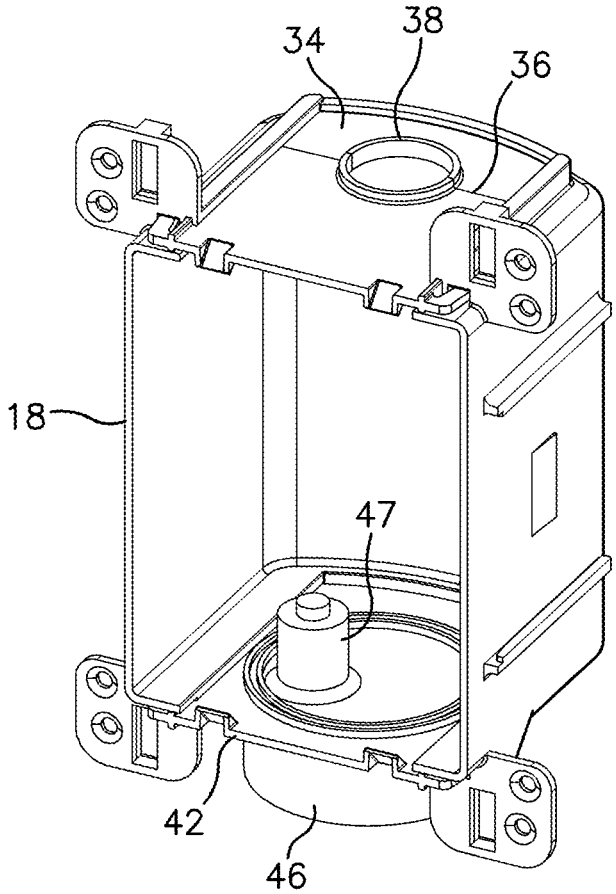

As depicted in FIGS. 14 and 15, in one embodiment, an adaptor plate 42 may be configured as a single piece and/or to accommodate a drain connection. The adaptor plate 42 may include a removeable knockout panel 44, a drain-connection feature 46 to enable coupling with a particular drain or other plumbing conduit or component, or other structure such as a test connector 47 for pressure testing a plumbing circuit. The adaptor plates 34, preferably a front adaptor plate 34F, may include an ear 35, clip, tab, or similar feature that engages an opening 37, flange, or similar mating feature on the service box 18 or mounting tabs 48 thereon to aid retention of the adaptor plate 34 in a desired installed position in the slots 30. Thereby, the front adaptor plate 34F may trap a rear adaptor plate 34R within the slots 30 between the front adaptor plate 34F and the rear wall 32 of the service box 18.

Figure 7:
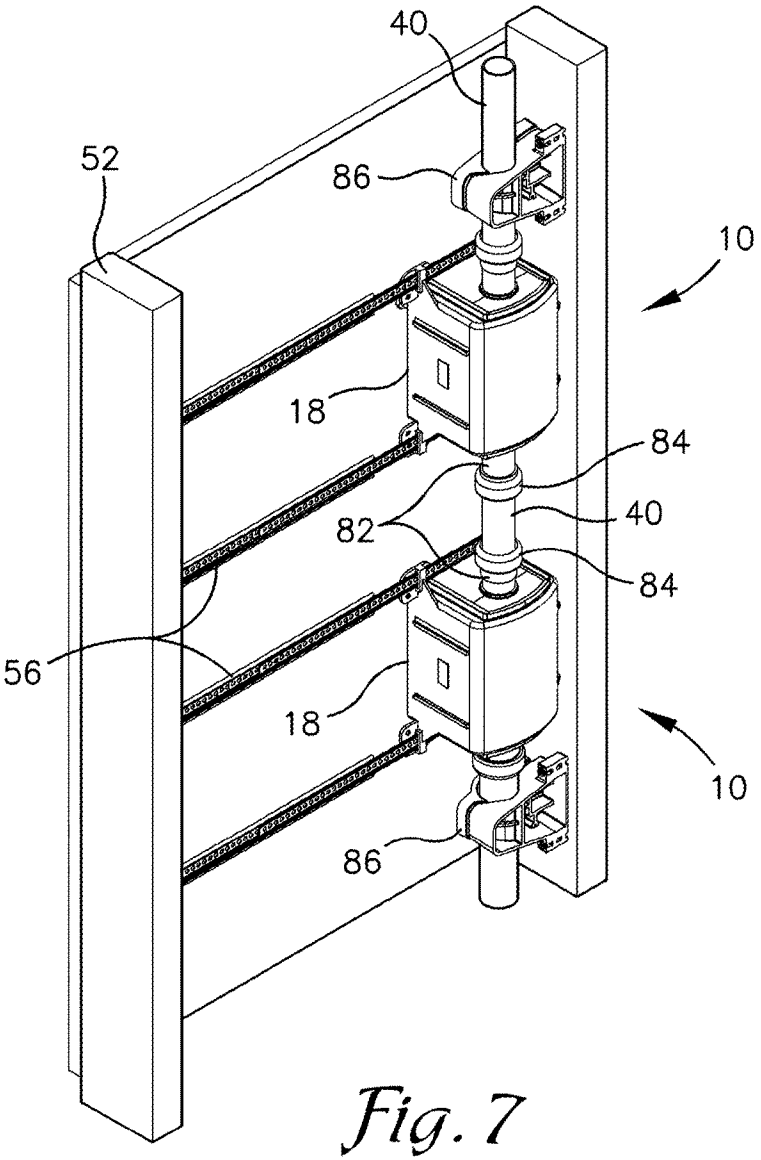
FIG. 7 is a perspective, back-side view of the valves and structure depicted in FIG. 6.
Figure 8:
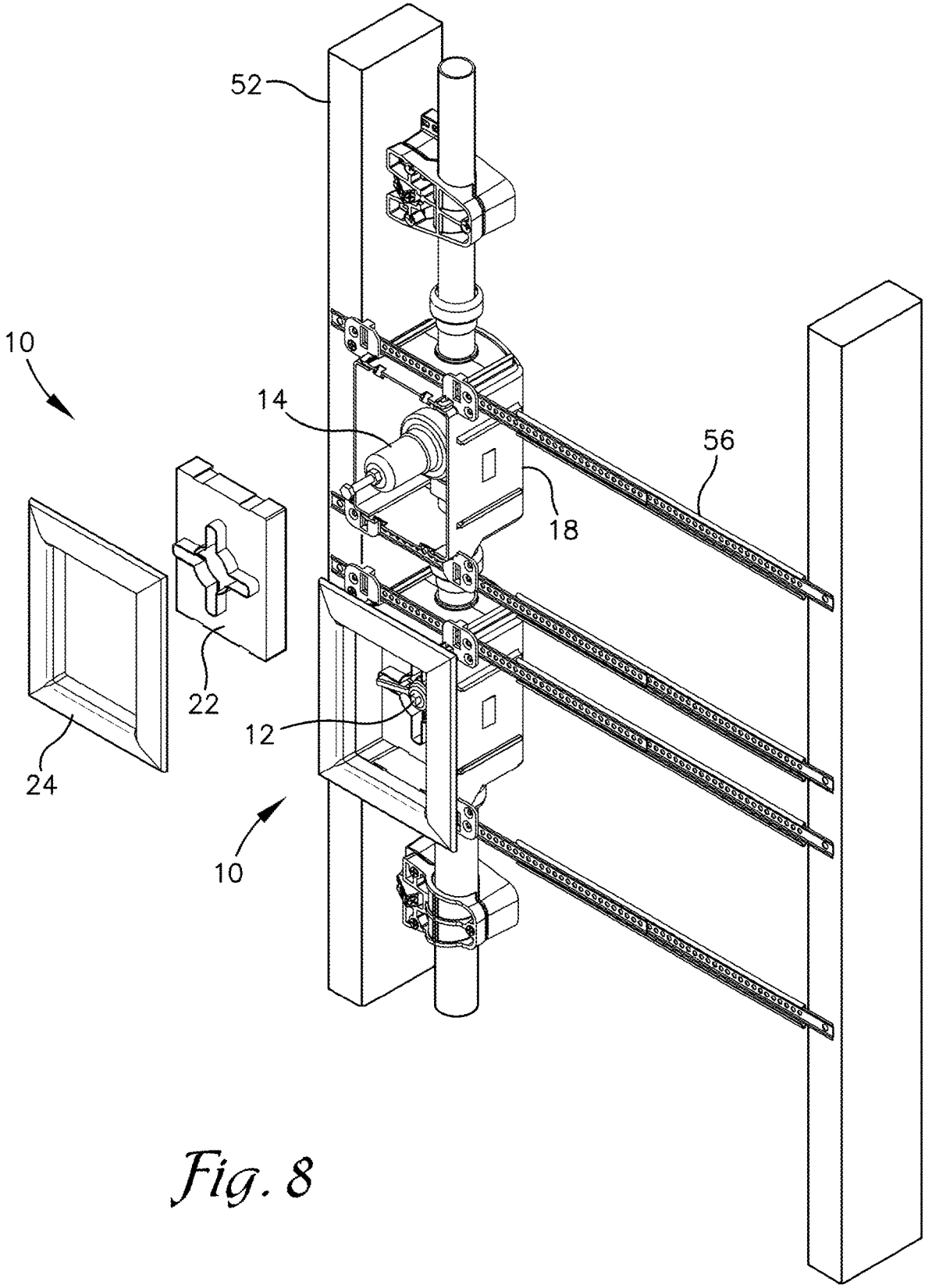
FIG. 8 is a partially exploded view of two plumbing service boxes with a pressure relief valve and a main supply valve installed therein in a wall of a structure with a wall panel removed to reveal a mounting structure for the boxes depicted in accordance with an exemplary embodiment.

The service box 18 may include one or more mounting features including mounting tabs 48 and bracket coupling slots 50. The mounting tabs 48 may be disposed and arranged in a variety of configurations to enable coupling of the service box 18 directly to a structure, such as a stud 52 in a wall 54 and/or to one or more brackets 56 configured to couple to the structure. For example, as depicted in FIGS. 5 and 7-8, the brackets 56 may comprise extensible members that extend between and fasten to the studs 52 in the wall 54. The brackets 56 further engage mounting loops 57 on the mounting tabs 48 to support one or more service boxes 18.

Figure 9:
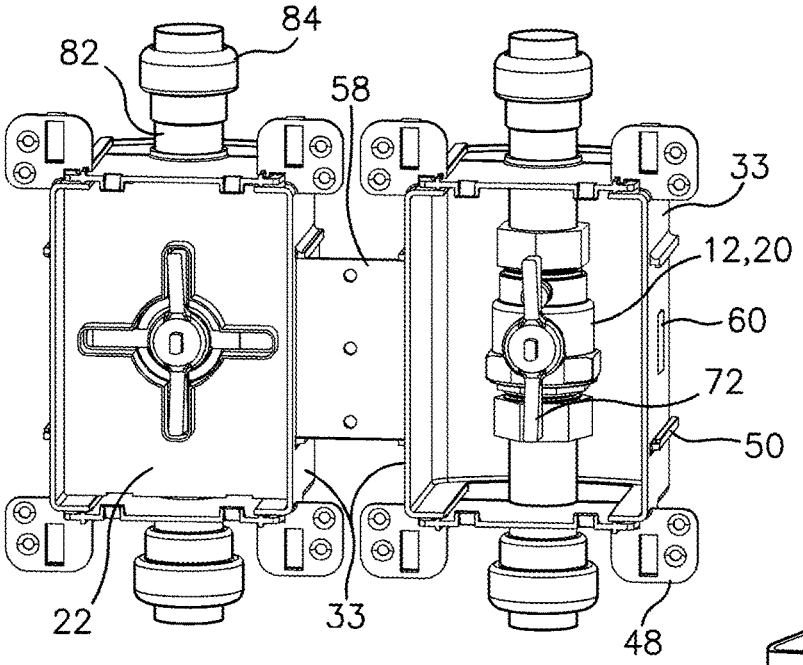
FIG. 9 is a perspective view of a pair of plumbing service box installations in a side-by-side configuration with a mounting bracket disposed therebetween and with finish trim rings and one positioning-debris cover removed and depicted in accordance with an exemplary embodiment.
Figure 10:
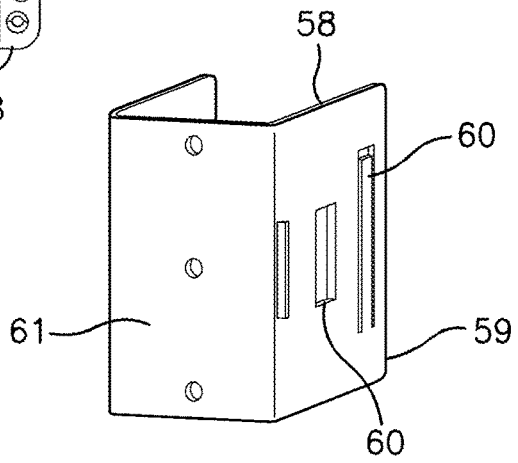
FIG. 10 is a perspective view of the mounting bracket of FIG. 9.
Figure 11:
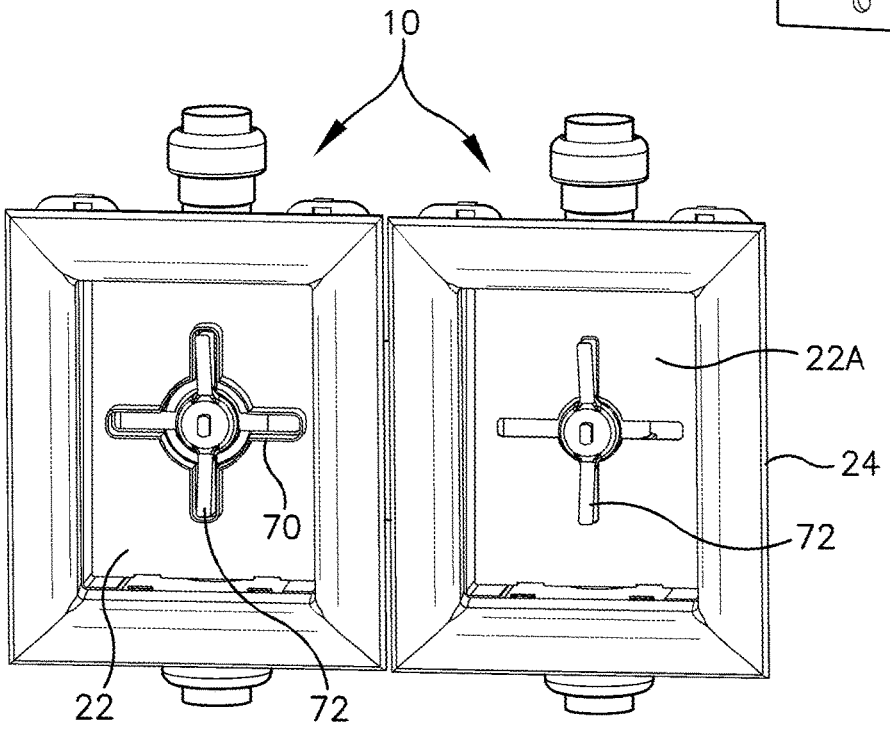
FIG. 11 is a perspective view of the plumbing service boxes of FIG. 9 depicted with the positioning-debris covers and trim rings installed thereon.

The bracket coupling slots 50 comprise a pair of opposing hooked or L-shaped flanges along one side wall 33 of the service box 18 that are spaced apart and configured to slideably receive a stud-bracket 58. As depicted in FIGS. 9-11, the stud-bracket 58 is provided with a pair of spaced-apart, parallel side walls 59 and an intermediate wall 61 extending therebetween to form a generally C-shaped component. The stud-bracket 58 is sized to receive a common stud 52 between the sidewalls 59 thereof with the intermediate wall 61 abutting a surface of the stud 52 to enable fasteners, such as screws or nails to be installed therebetween. Each of the side walls 59 may be disposed in the bracket coupling slots 50 of a respective service box 18 to enable mounting of the service boxes 18 to the stud 52 and on opposite sides thereof. Alternatively, the stud-bracket 58 may be employed to couple a pair of service boxes 18 together side-by-side and to maintain a proper spacing therebetween without coupling the stud-bracket 58 to the stud 52, as depicted in FIGS. 9 and 11. The stud-bracket 58 and/or the side wall 33 of the service box 18 may include one or more detents, clips, or similar features 60 to provide a mechanical interlocking therebetween.

Figure 3:
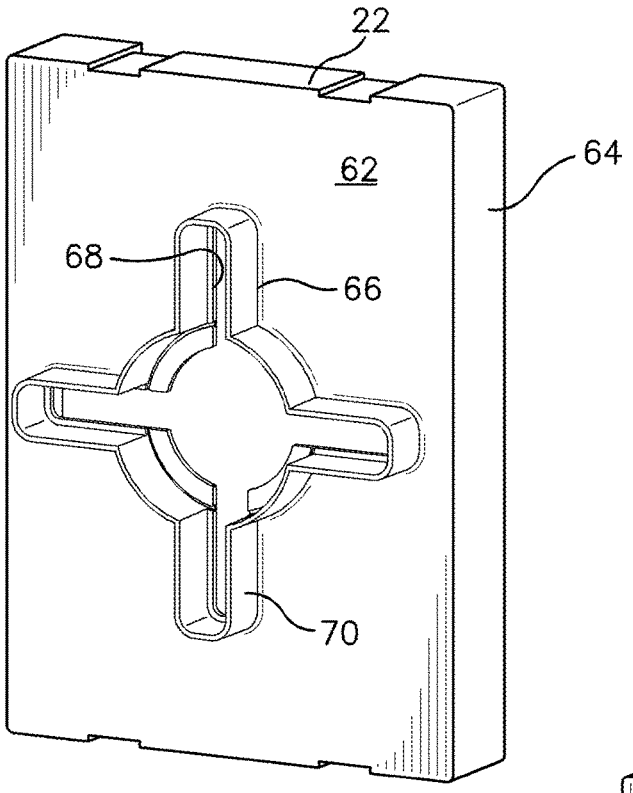
FIG. 3 is a perspective view of a positioning-debris cover of the plumbing service box installation of FIG. 1.
Figure 4:
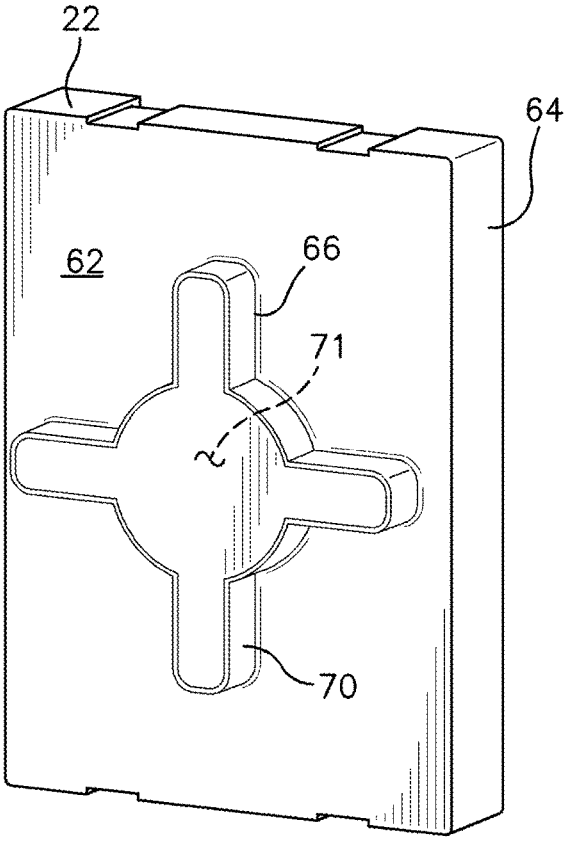
FIG. 4 is a perspective view of a closed-face positioning-debris cover of a plumbing service box installation depicted in accordance with an exemplary embodiment.

Referring now to FIGS. 3 and 4, the positioning-debris cover 22 comprises a planar body 62 with a perimeter wall 64 and a receiver 66. The body 62 is generally rigid and has dimensions just smaller than the interior dimensions of the inside of the service box 18 such that the body 62 is receivable through the open face of the service box 18 and into the interior thereof when aligned in a plane parallel to the plane of the open face.

The perimeter wall 64 is provided along the entire perimeter of the body 62 and extends rearwardly from the body 62 in a direction that is generally perpendicular to the plane of the body 62. In another embodiment, the perimeter wall 64 only extends along a portion of the perimeter of the body 62 or is comprised of a plurality tabs or flanges that are spaced about the perimeter thereof. The perimeter wall 64 extends from the body 62 a sufficient distance to at least partially support the positioning-debris cover 22 against substantial pivotal movement when installed within the interior of the service box 18, i.e. to maintain the body 62 in a plane generally parallel to the open front face of the service box 18. The perimeter wall 64 preferably abuts or contacts and is slideable along the interior surfaces of the service box 18 when installed therein. In one embodiment, the perimeter wall 64 is spaced apart from interior surfaces of the service box 18 a short distance, e.g. less than about five millimeters.

Surfaces on the interior of the service box 18 and/or the perimeter wall 64 may include features, such as lips, flanges, steps, shoulders, or other protuberances that may guide insertion of the positioning-debris cover 22 into the service box 18, aid alignment of the positioning-debris cover 22 within the interior, and/or define an extent to which the positioning-debris cover 22 can travel into the service box 18. Features may also be provided to releasable engage the positioning-debris cover 22 to aid retention thereof within the service box 18.

The receiver 66 is formed in the planar body 62 and is sized and configured to enable at least a portion of the plumbing fitting 20, such as the main service valve 12, the pressure relief valve 14, or the quarter-turn valve 16 to pass through the planar body 62 of the positioning-debris cover 22. The receiver 66 is provided with an outline that closely mimics the form of the associated plumbing fitting 20 to be received therethrough such that when inserted therethrough, the plumbing fitting 20 is abutted by or in close proximity to an edge 68 of the receiver 66. The receiver 66 may include a boundary wall 70 along at least a portion of the perimeter of the receiver 66 and extending forwardly away from the interior of the service box 18 and generally perpendicularly to the planar body 62. In one embodiment, the boundary wall 70 extends rearwardly toward the interior of the service box 18 from an opposite face of the planar body 62 in addition to or instead of extending in the forward direction. As depicted in FIG. 4, in one embodiment the receiver 66 is closed off to form a blind bore, such as by providing a surface 71 comprised of a thin layer of material extending across a terminal edge of the boundary wall 70. In another embodiment, the planar body 62 is continuous and the boundary wall 70 extends inwardly or rearwardly to engage the plumbing fitting 20 within the service box 18.

Figure 1:
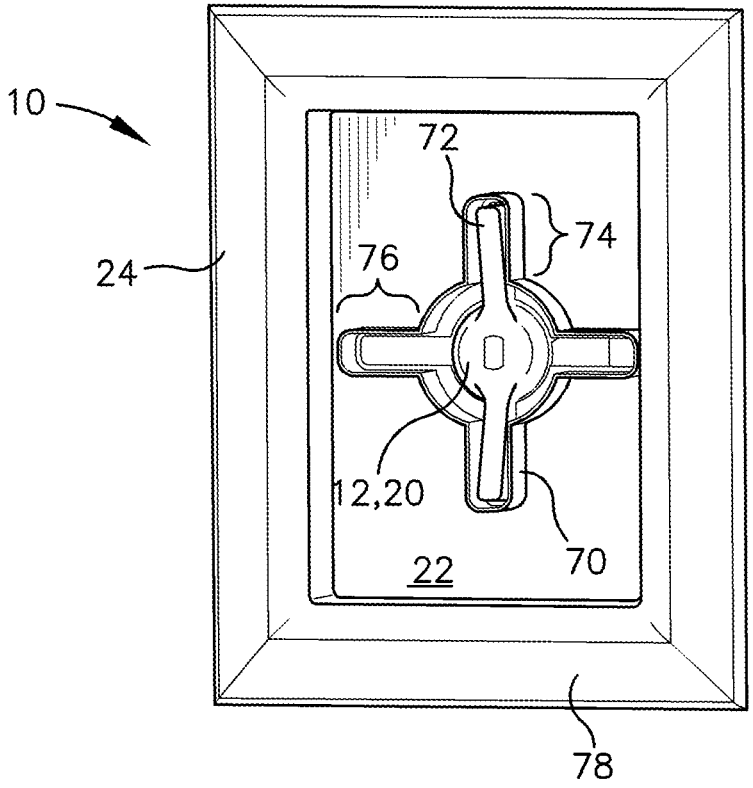
FIG. 1 is a front-side perspective view of a plumbing service box installation for a shut-off valve depicted in accordance with an exemplary embodiment.
Figure 2:
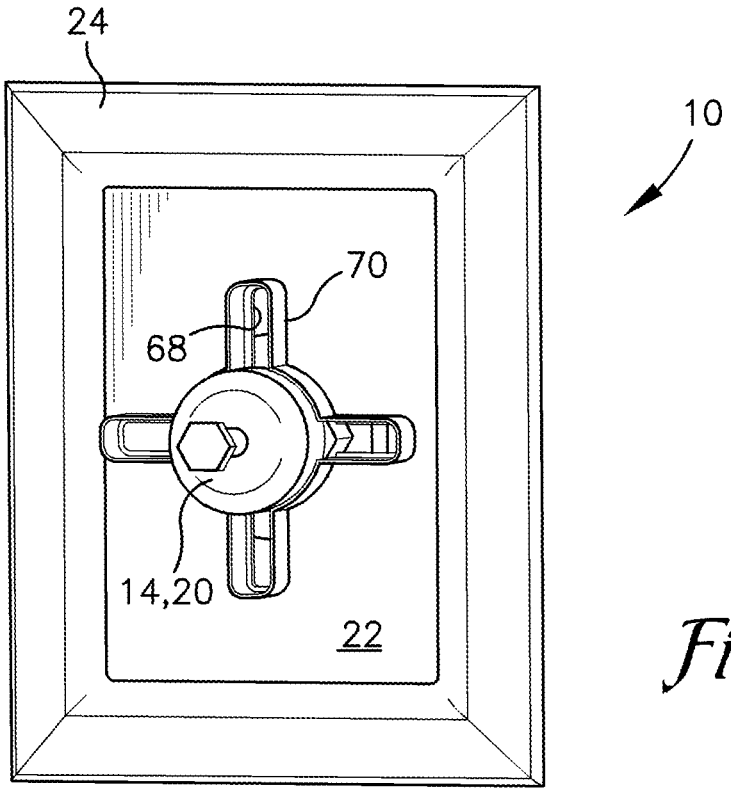
FIG. 2 is a front-side perspective view of a plumbing service box installation for a pressure-relief valve depicted in accordance with an exemplary embodiment.

The receiver 66 may be configured to receive a valve handle 72 or actuator in one or more positions. For example, FIG. 1 depicts the valve handle 72 in a first position and within a first portion 74 of the receiver 66 while a second portion 76 of the receiver 66 which is configured to receive the valve handle 72 in a second position remains unused. The receiver 66 may also be formed to accommodate more than one type, style, or configuration of the plumbing fitting 20. As depicted in FIGS. 1 and 2, the receiver 66 is configured to interchangeably receive the main service valve 12 and the pressure relief valve 14. In another embodiment, more than one receiver 66 is provided in the planar body 62 to accommodate multiple valves 16 or fittings 20 installed in the single service box 18, as depicted in FIGS. 12-13.

With continued reference to FIGS. 1 and 3, the finish trim-piece 24 is configured to enclose or overlie an unfinished edge of the wall 54 surrounding the service box 18 to provide an aesthetically pleasing finished appearance. The trim-piece 24 thus is generally configured similarly to a frame or other decorative surround and may include any desired ornamentation. The trim-piece 24 includes a decorative frame portion 78 with an engagement wall 80 extending from a backside thereof and generally perpendicularly to the plane of the frame portion 78. The engagement wall 80 is dimensioned and oriented similarly to the perimeter wall 64 of the positioning-debris cover 22 to fit within the interior of the service box 18 and to be slideably received along the interior surfaces of the service box 18. The engagement wall 80 and the interior surfaces of the service box 18 may include one or more inter-engaging features configured to releasably retain a mechanical coupling therebetween.

Figure 16:
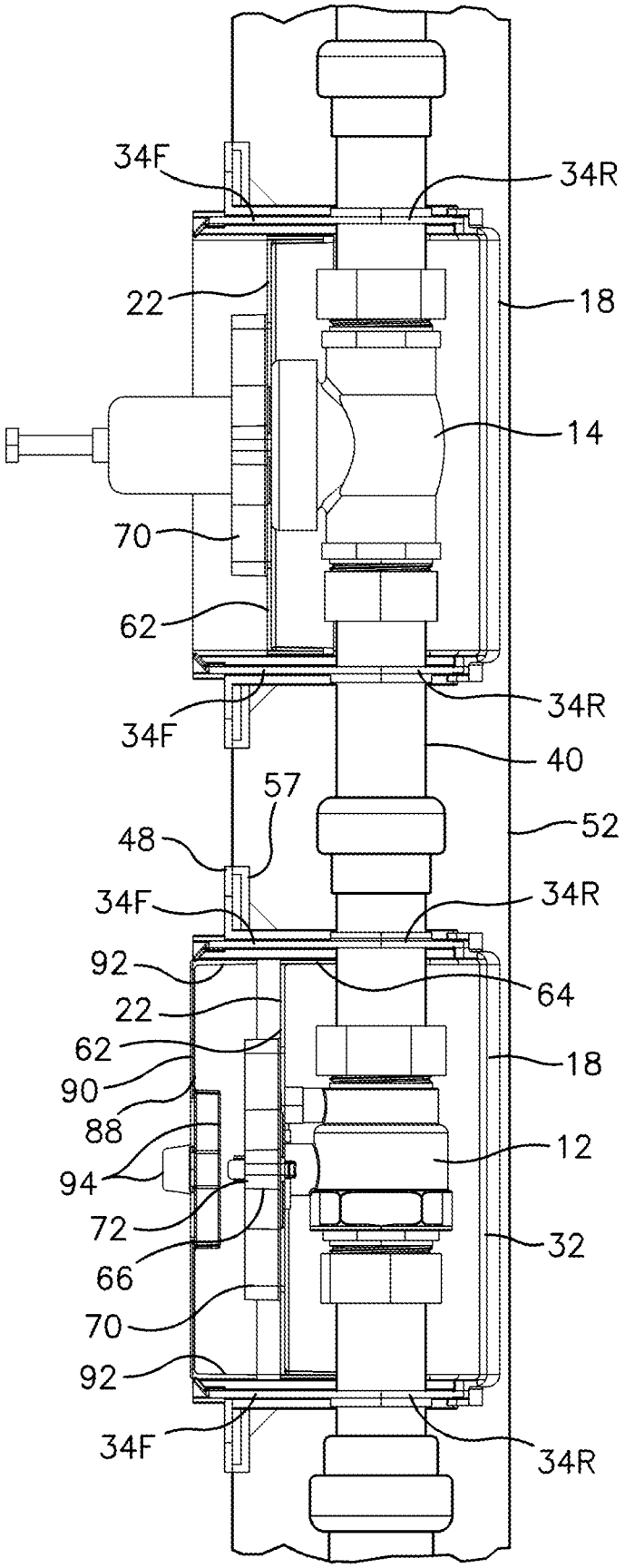
FIG. 16 is a cross-sectional view of two plumbing service boxes, one with a pressure relief valve and one with a main supply valve installed on a stud in a wall of a structure and with a secondary debris cover installed in the box housing the main supply valve depicted in accordance with another exemplary embodiment.

With additional reference to FIG. 16, in one embodiment a secondary debris cover 88 may be provided. The secondary debris cover 88 is configured similarly to the positioning-debris cover to include a planar body 90 with a perimeter wall 92 extending generally orthogonally about at least a portion of a perimeter thereof. The planar body 90 is fully enclosed or complete and may include one or more raised or depressed grasping features 94 formed therein. The grasping features 94 may be any three-dimensional form extending from or depressed into the planar body 90 to aid a user in grasping or holding the secondary debris cover 88 for insertion and/or removal from within the service box 18. The grasping features 94 may include one or more surface features or textures to aid grasping thereof. In another embodiment, the grasping features 94 may extend outwardly a sufficient distance and with a form sufficient to accept features of the fixture 20 mounted within the service box 18 that protrude beyond the open front face of the service box 18, like for example a portion of the pressure reducing valve 14 depicted in FIG. 16.

Like the positioning-debris cover 22, the secondary debris cover 88 is installable into the service box 18 through the open front face thereof. As depicted in FIG. 16, the positioning-debris cover 22 is preferably installed into the service box 18 first or between the secondary debris cover 88 and the rear wall 32 of the service box 18. The planar body 90 of the secondary debris cover 88 is preferably positioned generally in line with the open front face of the service box 18, i.e. with a front edge or perimeter of the walls of the service box 18. The secondary debris cover 88 thus encloses the positioning-debris cover 22 within the service box 18 and further protects against entrance of debris into the interior of the service box 18, onto the positioning-debris cover 22, and/or onto the exposed valve handle 72 or through the valve aperture 66 in the positioning-debris cover 22.

With reference now to FIGS. 5-8, installation of the plumbing service box assembly 10 is described in accordance with an exemplary embodiment. The plumbing fitting 20 is fitted with sections of conduit or tailpieces 82 having couplers 84, such as quick-connect or push-to-connect couplers disposed at distal ends thereof. Appropriate adaptor plate pairs 34 that provide apertures 38 corresponding in size to the dimensions of the tailpieces 82 are selected. A rear plate 34R of each adaptor plate pair 34 is installed into the slots 30 in each of the ends of the service box 18. The plumbing fitting 20 is disposed into the service box 18 with the tailpieces 82 engaging the apertures 38 in the rear adaptor plates 34R. Front adaptor plates 34F are installed into the slots 30 to capture the tailpieces 82 in the respective apertures 38 formed thereby.

The installation of the service box assembly 10 is described with respect to a configuration in which the plumbing fitting 20 includes tailpieces 82 extending through both the top and bottom walls 26, 28 of the service box 18, however such is not intended to be limiting; embodiments may include configurations in which the fitting 20 only includes a single tailpiece 82. In such embodiments, a one-piece adaptor plate 34 may be employed in the top or bottom wall 26, 28 through which the tailpiece 82 does not extend, or an adaptor plate pair 34 that does not include or form an aperture therethrough may be employed.

The plumbing fitting 20 is rotated and/or positioned within the service box 18 as necessary and the positioning-debris cover 22 is installed in the service box 18 to receive at least a portion of the plumbing fitting 20 within the receiver 66. For example, FIG. 1 depicts at least a portion of the handle 72 of a main service valve 12 and FIG. 2 depicts a portion of a body of a pressure relief valve 14 being received in the receiver 66. Engagement between the plumbing fitting 20 and the receiver 66 and/or the boundary wall 70 of the positioning-debris cover 22 secures the position and orientation of the plumbing fitting 20 within the service box 18. The plumbing fitting 20 thus is restricted against movement toward the top or bottom wall 26, 28 of the service box 18 and against rotation about an axis extending between the top and bottom walls 26, 28. Such engagement may also secure the position of the valve handle 72 to prevent actuation thereof as depicted, for example, in FIGS. 1 and 12. In one embodiment, the perimeter wall 64 of the positioning-debris cover 22 may engage interior walls of the service box 18 to releasably resist withdrawal of the positioning-debris cover 22.

The finish trim-piece 24 may be installed on the service box 18 or may be stored for later installation following completion of construction activities. When installed, a distal edge of the engagement wall 80 of the trim-piece 24 may abut the positioning-debris cover 22 to place the positioning-debris cover 22 in a desired position within the service box 18. The trim-piece 24 may also lock the positioning-debris cover 22 within the service box 18 or at least provide additional resistance to withdrawal of the positioning-debris cover 22 from the service box 18.

In a preferred embodiment, the above described assembly is completed during manufacturing and the plumbing service box assembly 10 is provided as a pre-assembled unit. The pre-assembly process may also include coupling a plurality of the valve assemblies 10 together on a single fluid circuit, in for example, a daisy chain configuration, like that depicted in FIGS. 6-8, in which the adjacent tailpieces 82 of a pair of assemblies 10 are coupled via a conduit 40. The pre-assembly process may also provide two or more assemblies 10 coupled side-by-side via the stud-bracket 58, as depicted in FIGS. 9 and 11.

Installation of the plumbing service box assembly 10 in a structure such as the wall 54 may be completed in a variety of ways. The assembly 10, may be coupled directly to the stud 52 by installing fasteners between the mounting tabs 48 on the service box 18 and the stud 52. Brackets 56 may alternatively or additionally be coupled between the studs 52 and to the mounting tabs 48 such as by insertion through the mounting loops 57. The service box 18 may also be coupled to the stud-bracket 58 which is further fastened to the stud 52 or to another service box 18. The plumbing lines of the structure can be coupled to the tailpieces 82 by known methods.

As depicted in FIG. 7, the service box 18 and the adaptor plate pairs 34 are preferably dimensioned to enable use of existing plumbing conduit bracketry 86, i.e. the centerline and/or other dimensions and placement of the tailpieces 82 correspond and are adaptable to available bracketry. Sheathing and other wall finishings are applied to the wall 54 as desired and by means known in the art. If pre-installed, the trim-piece 24 is removed from the assembly 10 to enable installation of the sheathing and wall finishings. The trim-piece 24 may then be reinstalled.

During these installation activities, the engagement of the plumbing fitting 20 with the positioning-debris cover 22 retains the plumbing fitting 20 properly oriented and positioned within the service box 18. The positioning-debris cover 22 also aids to resist entrance of much of the construction debris into the service box 18. In one embodiment depicted in FIG. 4, the receiver 66 in the positioning-debris cover 22 is closed off to form a blind bore in which a portion of the plumbing fitting 20 is received but remains enclosed and protected from construction debris and activities within the service box 18. For example, in the embodiment depicted in FIG. 4, the positioning-debris cover 22 provides additional protection of the plumbing fitting 20 and interior of the service box 18 against paint being sprayed into the service box 18 among other sources of dirt and debris. In one embodiment, the secondary debris cover 88 may be installed to further enclose the interior of the service box 18 as well as to protect the positioning-debris cover 22 from debris. In another embodiment in which maintaining the position of the fitting 20 within the service box 18 is of lesser or no importance, the secondary debris cover 88 may be employed instead of the positioning-debris cover 22. Such may be the case, for example, when the service box 18 is employed for access to a drain line or when the fitting 20 is coupled to the top or bottom walls 26, 28 of the service box 18, among others.

Figure 6:
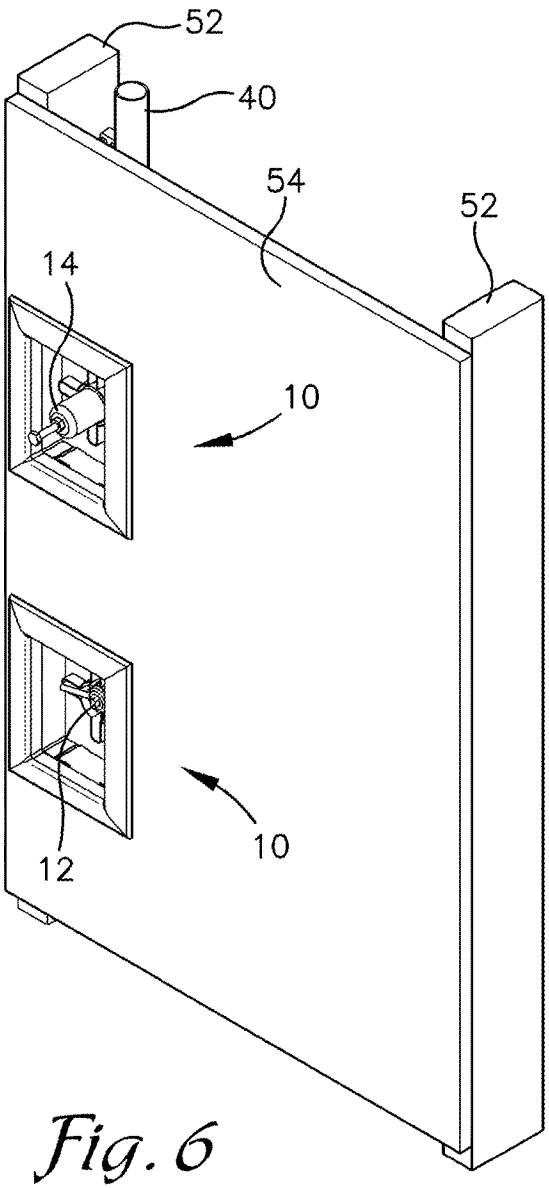
FIG. 6 is a perspective, front-side view of two plumbing service boxes, one with a pressure relief valve and one with a main supply valve installed in a wall of a structure depicted in accordance with an exemplary embodiment.

Following completion of construction activities, the trim-piece 24 may be installed to provide an aesthetically pleasing finished appearance to the plumbing service box assembly 10 as depicted in FIGS. 1-2 and 6. The positioning-debris cover 22 may be removed prior to installation of the trim-piece 24 or may be retained in position to provide continued protection against collection of debris in the service box 18 and/or to provide a desired aesthetic appearance, e.g. to hide a body of the valve and plumbing connections therewith from view.

Figure 17:
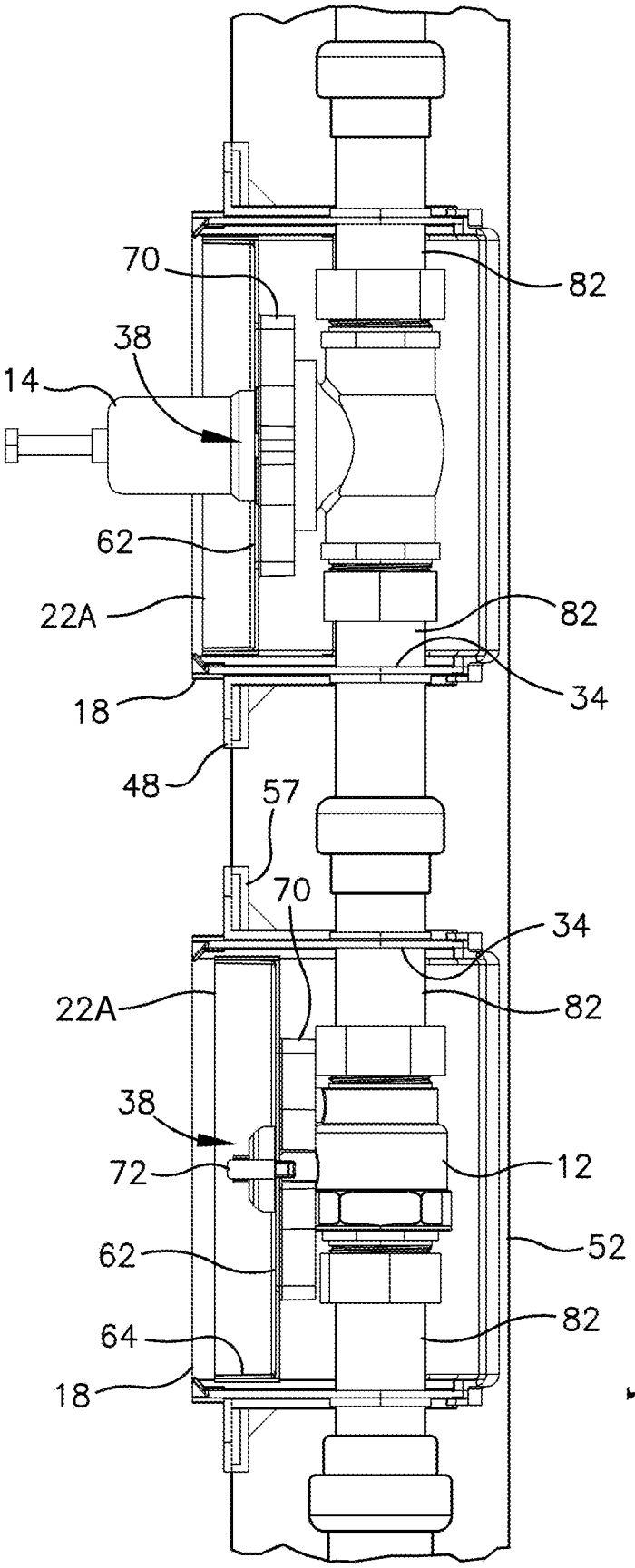
FIG. 17 is a cross-sectional view of the two plumbing service boxes of FIG. 16 with the secondary debris cover removed and with positioning-debris covers reversed in orientation depicted in accordance with an exemplary embodiment.

Retention of the positioning-debris cover 22 in position may also be employed to resist inadvertent or unwanted actuation of the valve handle 72, i.e. to provide a tamper-proof or tamper-resistant feature to the assembly 10. When actuation of the valve handle 72 is desired the trim-piece 24 and the positioning-debris cover 22 may be simply removed to enable operation of the valve handle 72 and then reinstalled. In one embodiment, prior to installation of the trim-piece 24, the positioning-debris cover 22 is removed, reversed such that the perimeter wall 64 extends forwardly, and then reinstalled in the service box 18, as depicted in FIGS. 11 and 17 by positioning-debris cover 22A. In this configuration the boundary wall 70 around the receiver 66 is directed rearwardly into the service box 18 and does not obstruct operation of the valve handle 72. And the previously outwardly facing surface of the planar body 62 of the positioning-debris cover 22, which may be soiled from construction activities, is now concealed from view while the previously inward facing surface, which was protected from construction activities and is likely generally clean, faces outwardly to provide a clean, pleasing appearance.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A plumbing service box assembly comprising:

a hollow cuboidal body having an open front face and a first wall, the first wall forming a first cutout that is open to the front face of the body;

a first adaptor plate slideably installed on the body and enclosing the first cutout, the first adaptor plate including at least one of an aperture configured to receive a plumbing conduit therethrough or a connection feature configured to couple to the plumbing conduit, wherein the first adaptor plate further comprises:

a front plate that is slideably installed on the body; and a rear plate that is slideably installed on the body between the front plate and a rear wall of the body, the front plate and the rear plate together enclosing the first cutout, and adjacent edges of the front plate and the rear plate forming a conduit aperture that is dimensioned to receive the plumbing conduit therethrough.

2. The plumbing service box assembly of claim 1, wherein at least a portion of a perimeter of the first wall around the cutout includes a first slot and wherein the first adaptor plate is slideably installed in the slot.

3. The plumbing service box assembly of claim 1, further comprising:

a second wall opposite the first wall, the second wall forming a second cutout that is open to the front face of the body; and a second adaptor plate slideably installed on the body and enclosing the second cutout, the second adaptor plate including at least one of a second aperture configured to receive a second plumbing conduit therethrough or a second connection feature configured to couple to the second plumbing conduit.

4. The plumbing service box assembly of claim 1, wherein the front plate and the rear plate are selectable to provide a conduit aperture with a desired dimension.

5. The plumbing service box assembly of claim 1, further comprising:

a plurality of mounting tabs extending outwardly from the body in a plane that is parallel to the open front face of the body, at least one of the mounting tabs including an opening; and an ear extending from the first adaptor plate and configured to releasably engage the opening in the mounting tab, engagement between the ear and the opening releasably retaining the first adaptor plate on the body.

6. The plumbing service box assembly of claim 1, further comprising:

a cover having a planar face, a perimeter wall, and a receiver, the cover being installable into the body through the open front face with the planar face being aligned in a plane parallel to the open front face, the perimeter wall extending substantially perpendicularly to the planar face and along at least a portion of a perimeter of the planar face, and the receiver being formed on the planar face and configured to receive at least a portion of a plumbing fitting therein.

7. The plumbing service box assembly of claim 6, wherein the receiver comprises an aperture through the planar face that is sized and shaped to receive the portion of the plumbing fitting therethrough.

8. The plumbing service box assembly of claim 6, wherein the receiver comprises a boundary wall extending from the planar face in a configuration that is sized and shaped to receive the portion of the plumbing fitting within and between opposing portions of the boundary wall.

9. The plumbing service box assembly of claim 6, wherein the receiver comprises an aperture through the planar face with a boundary wall extending from the planar face along at least a portion of a perimeter of the aperture, the aperture and the boundary wall being sized and shaped to at least partially receive the portion of the plumbing fitting therethrough.

10. The plumbing service box assembly of claim 6, wherein the plumbing fitting is installed in the body and engages the receiver, engagement between the plumbing fitting and the receiver resisting movement of the plumbing fitting toward the first wall and an opposite second wall of the body and resisting rotational movement of the plumbing fitting about an axis extending between the first wall and the second wall.

11. The plumbing service box assembly of claim 6, wherein the plumbing fitting comprises a valve with a valve handle, and the plumbing fitting is installed in the body and engages the receiver, and wherein engagement between the plumbing fitting and the receiver resists operation of the valve handle.

12. The plumbing service box assembly of claim 6, wherein the cover includes a construction orientation and a finish orientation, in the construction orientation a first side of the planar face is directed outward from the body and is exposed to dust and debris produced by a construction operation and an opposite second side of the planar face is directed toward an interior of the body and protected from the dust and debris, and in the finish orientation the second side of the planar face is directed outward from the body to provide a clean, aesthetically pleasing finish appearance while the coilod first side is directed toward the interior of the body.

13. The plumbing service box assembly of claim 12, wherein the plumbing fitting comprises a valve with a valve handle, and wherein in the construction orientation the receiver obstructs operation of the valve handle, and in the finish orientation the receiver does not obstruct the valve handle.

14. The plumbing service box assembly of claim 6, further comprising:

a secondary cover having a planar body and a second perimeter wall extending orthogonally to the planar body along at least a portion of a perimeter of the planar body, the secondary cover being installable into the body through the open front face with the planar body being aligned in a plane parallel to the open front face, the cover being enclosed within the body between the secondary cover and the plumbing fitting.

15. The plumbing service box assembly of claim 14, wherein the secondary cover includes a grasping feature formed in the planar body that is configured to aid insertion and withdrawal of the secondary cover from the body.

16. A plumbing service box assembly comprising:

a hollow cuboidal body having an open front face, a first wall, and a second wall disposed opposite the first wall, the first wall forming a first cutout that is open to the front face of the body, the second wall forming a second cutout that is open to the front face of the body;

a first adaptor plate assembly slideably installed on the body and enclosing the first cutout, the first adaptor plate assembly comprising a front plate that is slideably installed on the body; and a rear plate that is slideably installed on the body between the front plate and a rear wall of the body, the front plate and the rear plate together enclosing the first cutout, and adjacent edges of the front plate and the rear plate forming a conduit aperture that is dimensioned to receive a plumbing conduit therethrough;

a second adaptor plate slideably installed on the body and enclosing the second cutout, the second adaptor plate including at least one of an aperture configured to receive a plumbing conduit therethrough or a connection feature configured to couple to the plumbing conduit; and a cover having a planar face, a perimeter wall, and a receiver, the cover being installable into the body through the open front face with the planar face being aligned in a plane parallel to the open front face, the perimeter wall extending substantially perpendicularly to the planar face and along at least a portion of a perimeter of the planar face, and the receiver being formed on the planar face and configured to receive at least a portion of a plumbing fitting.

17. The plumbing service box assembly of claim 16, further comprising:

a secondary cover having a planar body and a second perimeter wall extending orthogonally to the planar body along at least a portion of a perimeter of the planar body, the secondary cover being installable into the body through the open front face with the planar body being aligned in a plane parallel to the open front face, the cover being enclosed within the body between the secondary cover and the plumbing fitting.

18. A plumbing service box assembly comprising:

a hollow cuboidal body having an open front face and a first wall wherein a first cutout that is open to the front face of the body is formed in the first wall; a first adaptor plate assembly having a first front plate and a first rear plate slideably installed on the body and enclosing the first cutout, adjacent edges of the first front plate and first rear plate forming a first conduit aperture that is dimensioned to receive a first plumbing conduit therethrough.

19. The plumbing service box assembly as in claim 18 wherein the hollow cuboid body further comprises a second wall disposed opposite the first wall, wherein a second cutout, open to the front face of the body, is formed in the second wall and the plumbing service box assembly further comprises a second adaptor plate assembly having a second front plate and a second rear plate slideably installed on the body and enclosing the second cutout, adjacent edges of the second front and second rear plates forming a second conduit aperture that is dimensioned to receive a second plumbing conduit therethrough.

20. The plumbing service box assembly as in claim 18 wherein the hollow cuboid body further comprises a second wall disposed opposite the first wall, wherein a second cutout, open to the front face of the body, is formed in the second wall and the plumbing service box assembly further comprises a second adaptor plate slideably installed on the body and enclosing the second cutout, the second adaptor plate including a connection feature configured to couple to a second plumbing conduit.

21. The plumbing service box assembly as in claim 19 further comprising:

a cover having a planar face, a perimeter wall, and a receiver, the cover being installable into the body through the open front face with the planar face being aligned in a plane parallel to the open front face, the perimeter wall extending substantially perpendicularly to the planar face and along at least a portion of a perimeter of the planar face, and the receiver being formed on the planar face and configured to receive at least a portion of the plumbing fitting therein; and a plumbing fitting disposed in the body, the plumbing fitting including the first plumbing conduit and the second plumbing conduit extending from opposite ends thereof and through the first and second conduit apertures respectively, the plumbing fitting engaging the receiver in the cover, and the engagement resisting movement of the plumbing fitting toward the first wall and the second wall and resisting rotational movement of the plumbing fitting about an axis extending between the first wall and the second wall.

22. The plumbing service box assembly of claim 18, wherein at least a portion of a perimeter of the first wall around the cutout includes a first slot and wherein the first front plate and the first rear plate are slideably installed in the slot.

23. The plumbing service box assembly of claim 18, further comprising:

a cover having a planar face, a perimeter wall, and a receiver, the cover being installable into the body through the open front face with the planar face being aligned in a plane parallel to the open front face, the perimeter wall extending substantially perpendicularly to the planar face and along at least a portion of a perimeter of the planar face, and the receiver being formed on the planar face and configured to receive at least a portion of a plumbing fitting therein.

* * * * *